US008696228B1

(12) United States Patent
Sobel

(10) Patent No.: US 8,696,228 B1
(45) Date of Patent: Apr. 15, 2014

(54) COSMETIC MARKER

(75) Inventor: Robert Sobel, Santa Fe, NM (US)

(73) Assignee: HairMarker LLC, Santa Fe, NM (US)

( * ) Notice: Subject to any disclaimer, the term of this patent is extended or adjusted under 35 U.S.C. 154(b) by 441 days.

(21) Appl. No.: 13/093,617

(22) Filed: Apr. 25, 2011

Related U.S. Application Data

(60) Provisional application No. 61/327,211, filed on Apr. 23, 2010.

(51) Int. Cl.
*A45D 19/00* (2006.01)
*B43K 1/12* (2006.01)

(52) U.S. Cl.
CPC ..... *B43K 1/12* (2013.01)
USPC ..... 401/198; 401/199

(58) Field of Classification Search
USPC ..... 401/198, 199
See application file for complete search history.

(56) References Cited

U.S. PATENT DOCUMENTS 3,133,307 A * 5/1964 Steinberg et al. ..... 401/199
4,269,529 A * 5/1981 McCollough ..... 401/258
4,588,319 A * 5/1986 Niemeyer ..... 401/205
4,749,618 A * 6/1988 Kawaguchi et al. ..... 428/375
4,973,180 A * 11/1990 Hori ..... 401/141
5,411,345 A * 5/1995 Ueji et al. ..... 401/206
5,480,250 A * 1/1996 Birden ..... 401/199
5,607,766 A * 3/1997 Berger ..... 428/373
5,885,020 A * 3/1999 Rossi ..... 401/198
5,964,266 A * 10/1999 Boiocchi et al. ..... 152/209.2
5,971,646 A * 10/1999 Chavatte et al. ..... 401/199
6,299,374 B1 * 10/2001 Naor et al. ..... 401/198
7,135,507 B2 * 11/2006 Sexton ..... 523/161
7,364,614 B2 * 4/2008 Kwan et al. ..... 106/31.86
7,611,300 B2 * 11/2009 Oike ..... 401/34
2001/0003566 A1 * 6/2001 Yoshida et al. ..... 401/199
2003/0215281 A1 * 11/2003 Sexton et al. ..... 401/261
2005/0095055 A1 * 5/2005 Kwan et al. ..... 401/198

* cited by examiner

*Primary Examiner* — David Walczak
*Assistant Examiner* — Joshua Wiljanen
(74) *Attorney, Agent, or Firm* — Buchanan Ingersoll & Rooney PC

(57) ABSTRACT

The current application is for a cosmetic marker device which applies a specifically formulated hair dye to the hair in a very controllable manner to the region proximate to hair roots to cover hair. Preferably, the hair is newly grown graying hair. The marker product of this invention employs a single fiber construction that delivers a specially formulated hair dye in a manner that enables the user to color just the area of hair that is of interest without staining the scalp to any large extent.

12 Claims, 3 Drawing Sheets

COSMETIC MARKER

CROSS-REFERENCE TO RELATED APPLICATIONS

This application claims priority to U.S. Provisional Patent Application No. 61/327,211, filed on Apr. 23, 2010. That application is incorporated by reference herein.

BACKGROUND OF THE INVENTION

1. Field of the Invention

Embodiments of the invention relate to systems and methods for application of cosmetic products. Particular embodiments related to application of hair dyes using a marker construct.

2. Background of the Art

Hair dyes have been known from antiquity and have progressed to the point in recent years where there are available permanent through completely washable dyeing systems covering the needs of professional application through to home usage and temporary dyeing techniques and mechanisms. All of these systems suffer the disadvantage that the user's or recipient's hair continues to grow following the application of the dyeing system, and the newly exposed hair shaft is not colored or dyed as was the older part of the shaft. This process takes but a few days, and in a matter of a week or more there is exposed a very visible hair color differential next to the scalp. The user of hair dye then has the problem of either repeating the original dyeing procedure or using a remedial dyeing system to cover the exposed natural hair coloration.

Of recent times there has been made available a touch up coloring method utilizing a brush cum sponge applicator and a small bottled amount of dye. Such an applicator has utility but suffers the disadvantage of requiring a bottle of liquid hair dye into which the applicator brush requires to be dipped frequently. Control over the amount of dye thus liberated onto the hair is limited. There is a very real potential for staining the scalp and of course spilling said bottle of dye.

Remedial dye systems have become available in recent times as noted above. However, and as again noted, the user is required to use a bottle, brush or sponge applicator to carefully apply hair dye to the roots of the hair principally to the hairline and to places where the hair is parted, revealing the hair line close to the scalp. This procedure obviates the necessity of frequent repeat hair dyeing sessions but lacks certain spontaneity in the usage of the system. For example, a user may notice at the last moment that a hair dye touch up is required, but he or she lacks the time to arrange bottle and brush application. Additionally this latter method requires careful usage to avoid staining the scalp and, for that matter anything that the dye may come into contact with in case of spillage and inadvertent contact.

Marker-type products of current commercial application are constructed from three basic components all contained within a plastic and/or metal envelope: dye, nib and reservoir. One hair product applicator and system is shown in U.S. Pat. No. 5,964,226, to Joan Lasker Sobel. The '226 patent is incorporated by reference as if fully rewritten herein. Valve-operated products are also known, but they lack the essential control of application that the product usage typically demands.

Together the dye, nib, and reservoir function as a system in which a normally fibrous reservoir meters dye through a nib. The nib and reservoir together form a capillarity gradient that meters dye to a surface when the product is used. To effect this transition the dye is typically formulated in the range of 1 through 10 Centi-Poise (cPs) and has an actual or close to Newtonian flow character. The reservoir is typically a fibrous reservoir of between 0.16 to 0.25 fiber density and capillarity of about 6 cms water gauge. The reservoir holds the dye, which is delivered through a fiber nib or point material of higher density and capillarity than the reservoir.

This simple mechanism is the manner by which dyeing systems have been delivered to the hair shaft in regular marker type constructions. To limit the degree to which or somewhat prevent any inadvertent application of the dye to the scalp there have been provided comb like devices that accommodate hair shafts and surround the nib or point. These also suffer the disadvantage of not easily allowing the hair to be dyed close to the scalp and leaving a witness of undyed hair.

What is desirable is a simple construct as above but which allows complete control of the dyeing action such that any dye delivered to the hair shaft stays exactly where it is placed and has no inherent tendency to continue to flow down the shaft and onto the scalp. To overcome these disadvantages embodiments of the invention seek to enable a user to apply hair dye in a very controllable manner precisely to the area which requires attention without frequent recourse to the dye bottle. This speeds the process and, for the first time, enables spontaneous application of the dye in a convenient and very controllable manner.

BRIEF SUMMARY OF THE INVENTION

Embodiments of the current invention avoid the negatives associated with the above bottle and brush method by providing a dye dispenser including a specially constructed reservoir and nib. Embodiments may use dyes that are not particularly suitable for other methods of delivery. They may provide a hair dyeing system that is completely controllable as to its application and can be stored easily in purses and the like making the product immediately available for use at any convenient time should the occasion arise. The invention contains the dye in a manner which obviates any tendency towards spillage and enables, through careful formulation of the dye, the application of said dye to the hair shafts proximate to the roots in a manner which coats the hair shaft in a thin layer of dye. Preferably, immediately following said application the dye ceases to flow and essentially stays where it has been placed. As will be seen it is the rheological nature of the dye that controls this aspect of application and lack of flow. This, in turn, imposes its unique requirements on the construction of a delivery system in the form of a marker device that forms the basis of the current invention.

Embodiments may be further improved by inclusion of a nib-retaining stirrup that prevents the nib from being forced into the reservoir when the system is in use. In one preferred embodiment the stirrup is integral with the marker body. The stirrup is sufficiently wide to support the nib, but not so wide that it prevents substantial reservoir-to-nib contact.

DESCRIPTION OF THE FIGURES

FIGS. 3 and 4 show different aspects of the same embodiment, with FIG. 4 directed to various functional aspects of the device. FIG. 5 shows a close-up view of the nib end of the applicator of FIGS. 3 and 4.

DETAILED DESCRIPTION OF THE INVENTION

Figure 1:
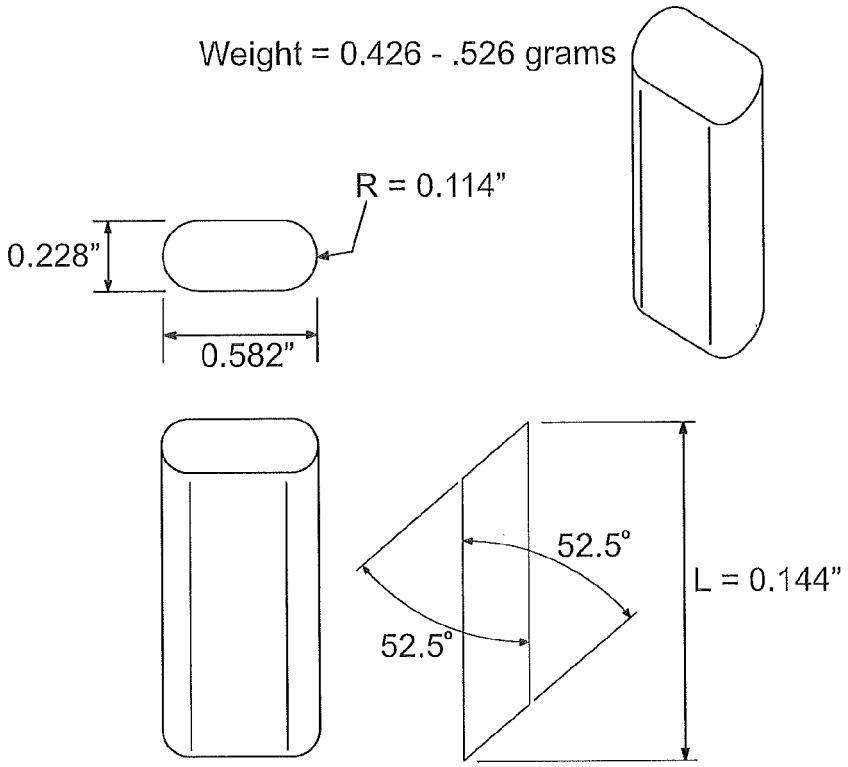
FIG. 1 shows a nib useful in a preferred embodiment of the invention. Dimensions are given for one embodiment and should not be construed to apply to all embodiments unless so stated in the claims.

Embodiments of the invention provide a system and device for delivery of a cosmetic. In preferred embodiments the cosmetic that is delivered is a hair dye. Embodiments of the invention typically include a reservoir in communication with a nib. Both the reservoir and the nib are typically disposed within a marker body. One suitable marker body is that disclosed in U.S. Pat. No. 5,964,226, to Joan Lasker Sobel. A hair dye is placed within the reservoir and is dispensed from the reservoir through the nib.

The dye used in embodiments of the invention is carefully controlled by its formulation and is formulated to flow under application but to resist further flow and stay where applied, much as has been claimed in recent years for the so called thixotropic paint systems. However as much as such systems may exhibit thixotropy they are more correctly termed "pseudoplastic" in their viscosity characteristics of utility. Additionally the dye exhibits a clear Bingham yield value which is frequently in the nature of pseudoplastic fluids, and this character is of value in retaining the dye where it is placed.

Dye solutions a used in embodiments of the invention may be, for example, those reported in U.S. Pat. No. 7,087,095 B2, granted to George Pollack, which is incorporated by reference herein. Those dyes include, for example, one or more acid dyes or solvent dyes (including cationic or anionic dyes), water, alcohol, an emulsion, and a polymeric rub-off protector. One emulsion that is suggested is a vinylpyrrolidone/styrene copolymer emulsion, and one polymeric rub-off protector is a vinylacetate/vinylpyrrolidone copolymer. The '095 patent claims dye with a rheological character sufficient "to be free flowing and yet not drip or cause a build up on the hair." In embodiments of the current invention the dye should exhibit a viscosity index (a ratio of low shear viscosity measurement to high shear) of at least 2.5:1, preferably higher than 3:1, more preferably between 3:1 and 4:1.

The resin additive types as specified in U.S. Pat. No. 7,087,095 operate well for the purposes of the invention. Other resins may be used alone or in combination, including PVP/VA resins of varying mole ratios, PVP, cellulose ethers, starch ethers and derivatives, alkali soluble acrylic resins, PVOH, maleic adducts and the like. Any water soluble or induced water soluble product (resin) that imparts a notable pseudoplastic character to the dye at low or limiting shear and because of which would not normally be used for dye for a marker application, may be used in an embodiment of the invention. This is the case even though when the dye as described above is placed within a typical delivery system, surprisingly it does not flow, the system having insufficient capillary force to effect any meaningful flow. Many combinations of reservoir and nib have been tried and found wanting.

To utilize the highly effective dye system of the invention it was found surprisingly that the optimum delivery system was not according to traditional knowledge, i.e. that of a capillary gradient where a nib has a much greater density and therefore capillarity than a reservoir. Instead, a most useful system was found to be a relatively low density reservoir/nib combination based on a single construction. Therefore, and for the first time, the so called nib and reservoir could be combined in a single product or product type. Together they may provide a system where the dye as described above, can be delivered in such quantity and regularity to make the invention usable and have market place utility.

Typically suitable reservoir/nib combinations involve the use of a 2-4 denier, preferably about 2.5 denier, bi-component fiber that is bonded throughout so as to derive a stiff rod like structure that has a tortuous path capillary structure. A suitable rod like structure may be used in the as-is state, i.e. as a rod serving both the functions of a nib and reservoir, or may be carved or ground to a shape that for the purposes of utility and function better mimics a traditional nib and reservoir structure. Those skilled in the art will recognize that pore size and pore structure may be varied by varying the composition of the nib and/or reservoir. In some embodiments of the invention the pore size is between 50 and 100 microns, preferably between 55 to 65 microns, and pore volume is between 70% and 80%. In a preferred embodiment the reservoir has a length to circumference ratio of 1:1, though in other embodiments a range of 1:0.8 to 1:1.6 may also be used.

A single rod-like material may form the complete system without any modification of the cross section as shown but with cutting or grinding so as to make a nib form or structure at one end. A separate nib and reservoir may be used provided that there is a close similarity of the density and thereby the capillary nature of said nib and reservoir materials. In a preferred embodiment the fibers are pull-truded, leading to an aligned or oriented configuration. This contrasts with random fibers, such as felts or other non-woven fibers, which may operate as more of a filter and less of a bundle of capillary fibers at the tip of the nib.

Figure 2:
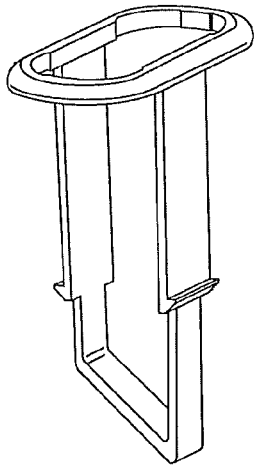
FIG. 2 shows a stirrup useful in some embodiments of the invention. This particular embodiment shows a stirrup that is not integral with the marker body.

Embodiments of the invention may include structures designed to prevent the nib from partially or fully pressing into the reservoir during dispensation of the dye. These structures may be, for example, but are not limited to, a stirrup. Of course, it will be understood that some penetration of the nib into the reservoir is desirable, and such a level of penetration may be maintained by the stirrup. One suitable stirrup is shown in FIG. 2. Another suitable stirrup is featured in FIG. 7. The embodiment shown in FIG. 7 has an integral stirrup, rather than a stirrup that is attached to the marker by spin welding or another process.

The nib may be of any cross-section, including, for example a circle, rectangle, flattened ellipse, square, or ellipse. One preferred cross-section is shown in FIG. 1. The end of the nib may be cut square or it may be cut at an angle. If the nib is a circular cylinder, then cutting the end of the nib at an angle will create a nib with a conic section as its end. Cutting a nib of any shape at an angle increases the surface area of the end of the nib, allowing application of a greater amount of dye at the distal end and/or more effective absorption of dye at the proximal end. The angle of the cut of the nib may be varied, both for ergonomic purposes and to adjust the dye flow rate. The interior angle of the cut (relative to the long axis of the nib) may be, for example, between 30° and 60°, preferably between 35° and 55°, and most preferably about 52.5°.

Densities of fiber structures for use as nibs may typically range from 0.05 to 3.0 gms/ml, preferably in the range from 0.10 to 0.15 gms/ml, 0.15 to 0.25 gms/ml, or 0.2 gms/ml. Fiber deniers are typically from 1.0 to 4.0. The fiber structure of choice is a core and sheath made from polyester materials where the sheath is a material with a lower melting temperature than the core. Other fibers of this or similar structure which derive the same function are within the scope of this invention.

Although applicant does not wish to be bound by theory, it is believed that the bi-component structure of the fibers that make up this type unit are used to create an artificially induced crimp in the fiber. This enables the fibers to firstly bond at points where the fibers touch but also to create an open tortuous path structure that permits the dye of the invention to flow through the interstices in an acceptable manner and flow rate.

A further embodiment of the invention that allows dyes of a distinct and normally intractable nature to be used in the manner noted above, is to marry a nib or point structure as described above with a reservoir structure of very uncommon design, having a fiber density of between 0.09 and 0.14 gms/ml, preferably between 0.10 and 0.12 gms/ml, most preferably less than 0.1 gms/ml. Such reservoirs are difficult to manufacture, having a fiber content well below so-called "normal" levels of utility. Reservoirs of such density range are highly disfavored in the marker industry.

In a preferred embodiment of the invention (though of course not the only embodiment of the invention), the fiber nib and reservoir are a bi-component polyester/polyethylene fiber matrix, with the polyester as the core and the polyethylene as a sheath. The nib and/or reservoir may also include or be entirely polyolefin fiber. A polyethylene sheath may be used to bond the matrices of one or more of the components together. The polyester gives stiffness to the nib, while the lower-melting polyethylene is fused at synapses of the fibers to give a bonded structure. The fiber may be melt-blown. The nib and reservoir may be a unitary fiber or may be in two pieces. In an embodiment the polyester is a poly hydroxy butyrate polyester, which leads to enhanced crimping. In an further embodiment the polyethylene is polyethylene terephthalate. In a preferred embodiment the nib and/or reservoir are treated in a surfactant, which may be, for example, but is not limited to, one or more of polysorbate 20, polysorbate 40, polysorbate 60, polysorbate 80, E20V-N, span 20, span 40, span 60, and span 80. In a yet still further embodiment the nib and/or reservoir are treated by heating or plasma treatment.

Figure 3:
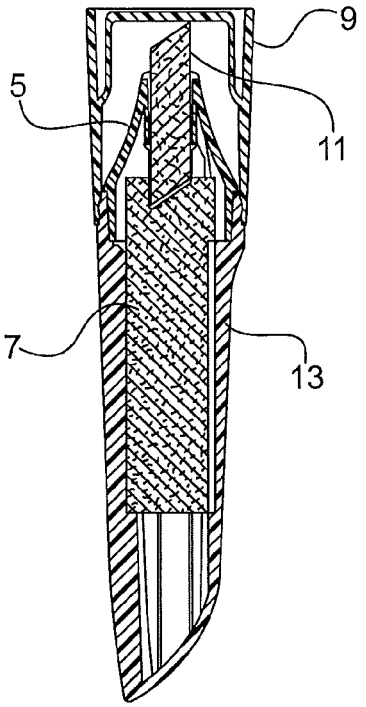
FIGS. 3, 4, and 5 show a complete applicator including a nib and reservoir according to an embodiment of the invention.
Figure 4:
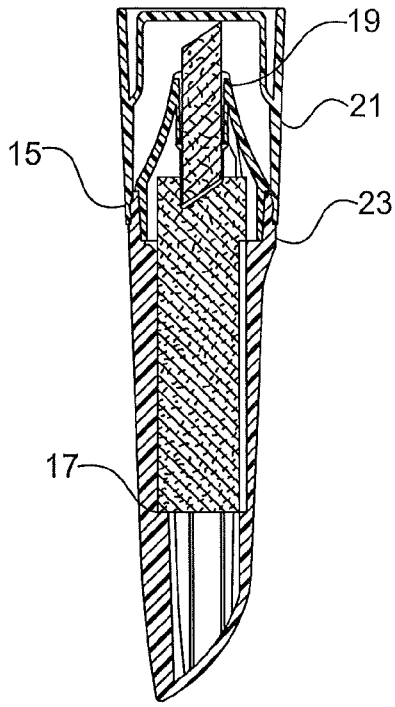
Figure 5:
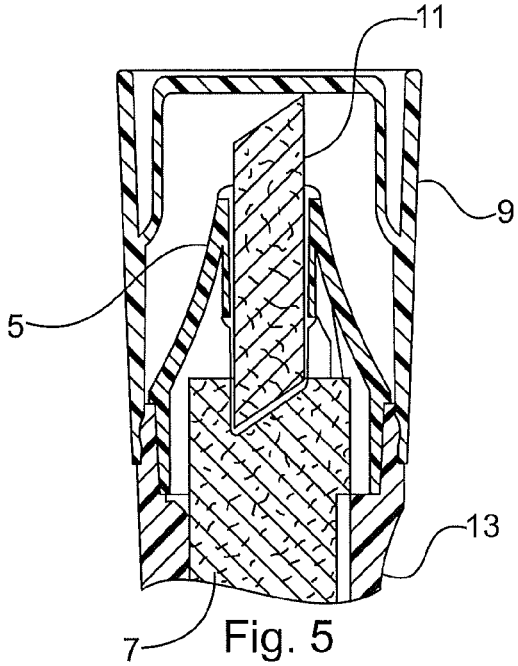
Figure 6:
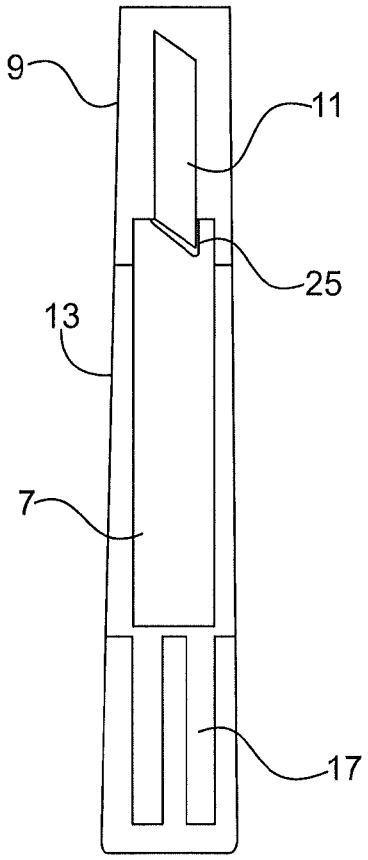
FIG. 6 shows a further embodiment of the applicator. In this case the stirrup is integral to the marker body.
Figure 7:
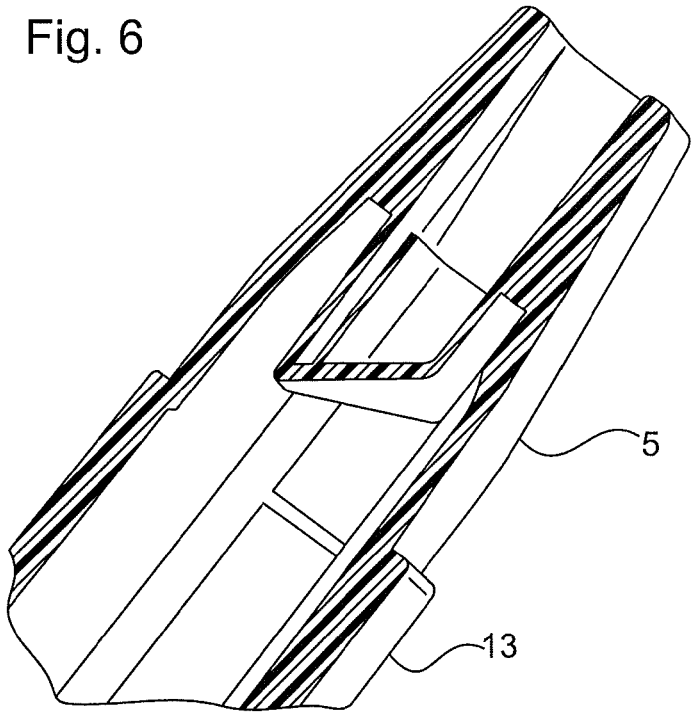
FIG. 7 shows an angled view of the marker body of FIG. 6, not including a nib or reservoir but featuring the integral nib retainer.

Embodiments of the invention may be further understood by direct reference to the figures. FIG. 3 shows a system of the invention having a nib retainer 5, a reservoir 7, a cap 9, a nib 11, and a barrel 13. Various functional aspects of that system are shown in FIG. 4, which shows an interference fit 15 between the cap and barrel, vertical retention ribs 17 with a reservoir depth control notch, a nib stirrup 19 that stops the nib from over-penetrating the reservoir, a snap 21 that keeps the nib from detaching from the nib retainer. In the embodiment of FIG. 4 there is a spin weld 23 where the stirrup is attached to the barrel 13. An interface 25 of the nib and reservoir is also shown. FIG. 6 shows a side cutaway view of an embodiment of the invention. This embodiment includes a stirrup that is integrally molded with the body of the marker. A detailed view is shown in FIG. 7. Production of this embodiment eliminates the step of securing the stirrup to the body.

EXAMPLES

Two separate reservoirs were prepared and charged with dye to demonstrate beneficial qualities of the reservoirs as used in embodiments of the invention. The properties of the first reservoir are given below in Table 1, and the properties of the second are given in Table 2. Each of these reservoirs, when combined with a nib as described below, gave even distribution of hair dye and had little chance of shock-induced dye leakage when charged with 7.5 grams of dye. Upon separation the reservoirs showed little mingling of the fibers. Reservoirs were a bi-component polyester/polyethylene fiber matrix.

TABLE 1

| | | Value | |
|---|---|---|---|
| Reservoir Diameter.(mm) | 15.3 | | |
| Wrap Thickness(mm) | 0.135 | | |
| Cross Sectional Area (mm2) | | 176.10 | |
| Reservoir Length (mm) | 56 | | |
| Reservoir Internal Vol (ml)--Inc Fiber | | 9.86 | |
| Reservoir Vol less Fiber | | 9.11 | |
| Fiber weight (gms) | 0.98 | | |
| Fiber Density | | 0.099 | |
| Fiber vol | | 0.75 | |
| Reservoir Initial Weight | 1.35 | | |
| Weight @ 10 secs | 6.76 | | |
| Adsorbed weight @ 10 secs | | 5.41 | |
| Weight @ 30 secs | 7.66 | | |
| Adsorbed weight @ 30 secs | | 6.31 | |
| Height at 10 secs | | 3.07 | |
| Height at 30 secs | | 3.58 | |
| Capillarity | | 3.91 | cms |
| Ink Absorption by Capillarity | | 6.80 | gms |
| Ink Capacity by fill 80% of Max | | 6.7 | gms |
| Ink Capacity by fill 90% of Max | | 7.6 | gms |

TABLE 2

| | | Value | |
|---|---|---|---|
| Reservoir Diameter.(mm) | 15.3 | | |
| Wrap Thickness(mm) | 0.135 | | |
| Cross Sectional Area (mm2) | | 175.97 | |
| Reservoir Length (mm) | 56 | | |
| Reservoir Internal Vol (ml)--Inc Fiber | | 9.86 | |
| Reservoir Vol less Fiber | | 9.03 | |
| Fiber weight (gms) | 1.08 | | |
| Fiber Density | | 0.110 | |
| Fiber vol | | 0.83 | |
| Reservoir Initial Weight | 1.44 | | |
| Weight @ 10 secs | 6.71 | | |
| Adsorbed weight @ 10 secs | | 5.27 | |
| Weight @ 30 secs | 7.99 | | |
| Adsorbed weight @ 30 secs | | 6.55 | |
| Height at 10 secs | | 2.99 | |
| Height at 30 secs | | 3.72 | |
| Capillarity | | 4.24 | |
| Ink Absorption by Capillarity | | 7.31 | gms |
| Ink Capacity by fill 80% of Max | | 6.7 | gms |
| Ink Capacity by fill 90% of Max | | 7.6 | gms |

Nibs were also prepared. One preferred embodiment had a density of 0.2 g/ml, as measured by absorption and dimensional assessment. Preferred embodiments also include a mingled fiber structure with only a slight grain (orientation) in line with the machine direction. In another preferred embodiment the nib had a density of 0.25 g/ml. This nib had considerable orientation in the machine direction, which gave a smooth feel to the nib. Both preferred nibs exhibited considerable bonding at the fiber conjunctions. Both were based on polyester or similar polymers, and fiber deniers were similar in each. Although any desired method of nib preparation may be used so long as the desired density and orientation are reached, in preferred embodiments the nibs are created by melt-blown extrusion followed by pulltrusion through a heated die, followed by steam injection. This method gives a desirable high degree of inter-fiber bonding.

I claim:

1. A hair dye application device comprising:

a reservoir, said reservoir having a proximal end and a distal end;

a nib having a distal end and a proximal end, the proximal end of said nib in communication with the distal end of the reservoir such that said nib is able to deliver a hair dye contained within the reservoir from the reservoir, through the distal end of the nib, and to a desired location;

a main body, said main body comprising an inner portion for containing said reservoir and at least part of said nib, said main body further comprising a retaining device for preventing movement of said nib into said reservoir, wherein said reservoir and said nib are melt-blown, grained, and comprise polyester fiber; and a pseudoplastic hair dye having a viscosity index greater than 2.5.

2. The hair dye application device of claim 1, wherein said reservoir has a density between 0.09 and 0.12 gms/ml.

3. The hair dye application device of claim 1, wherein said reservoir has a density of about 0.1 gms/ml.

4. The hair dye application device of claim 1, wherein said reservoir has a density of less than 0.12 gms/ml.

5. The hair dye application device of claim 1, wherein said nib has a fiber density between 0.10 to 0.15 gms/ml.

6. The hair dye application device of claim 5, wherein the distal end of the nib is in the shape of a circular cylinder, and wherein the distal end of the nib is cut at an interior angle of between 30 and 50 degrees relative to the length of the nib.

7. The hair dye application device of claim 1, wherein said hair dye comprises one or more water soluble dyes or solvent dyes, water, alcohol, an emulsion, and a polymeric rub-off protector.

8. The hair dye application device of claim 7, wherein said retaining device is a stirrup.

9. The hair dye application device of claim 8, wherein said stirrup is integral with the inner portion of the main body.

10. The hair dye application device of claim 1, said reservoir further comprising a polyethylene sheath.

11. The hair dye application device of claim 1, wherein at least one of said nib and said reservoir includes a surfactant.

12. The hair dye application device of claim 1, wherein said reservoir has a density between 0.15 and 0.25 gms/ml.

* * * * *